US009892674B2

(12) United States Patent
Chen

(10) Patent No.: US 9,892,674 B2
(45) Date of Patent: Feb. 13, 2018

(54) METHOD OF COMPUTING TARGET VALUES BASED ON BRIGHTNESS SWITCHING ON A SUBPIXEL SIGNAL

(71) Applicant: Shenzhen China Star Optoelectronics Technology Co., Ltd., Shenzhen, Guangdong (CN)

(72) Inventor: Lixuan Chen, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 105 days.

(21) Appl. No.: 14/780,062

(22) PCT Filed: Aug. 26, 2015

(86) PCT No.: PCT/CN2015/088078

§ 371 (c)(1),
(2) Date: Sep. 25, 2015

(87) PCT Pub. No.: WO2017/000368

PCT Pub. Date: Jan. 5, 2017

(65) Prior Publication Data

US 2017/0140694 A1 May 18, 2017

(30) Foreign Application Priority Data

Jun. 29, 2015 (CN) ..... 2015 1 0368396

(51) Int. Cl.
*G09G 3/20* (2006.01)
*G09G 3/36* (2006.01)

(52) U.S. Cl.
CPC ..... *G09G 3/2077* (2013.01); *G09G 3/2003* (2013.01); *G09G 3/3607* (2013.01);
(Continued)

(58) Field of Classification Search
CPC .. G09G 3/2077; G09G 3/2003; G09G 3/3607; G09G 2300/0452; G09G 2310/08
See application file for complete search history.

(56) References Cited

U.S. PATENT DOCUMENTS 7,319,449 B2 * 1/2008 Yamazaki ..... G09G 3/3648 345/103
7,898,519 B2 * 3/2011 Feng ..... G09G 3/342 345/102

(Continued)

FOREIGN PATENT DOCUMENTS

CN 102637400 A 8/2012
CN 103680448 A 3/2014

(Continued)

*Primary Examiner* — Sejoon Ahn
(74) *Attorney, Agent, or Firm* — Andrew C. Cheng

(57) ABSTRACT

A method of computing an overdriving target based on brightness switching on a subpixel signal includes: trying an overdriving target for obtaining a curve of R/G/B luminance and time response of the overdriving target, and determining if brightness of the curve of the R/G/B luminance and the time response of the overdriving target and the target brightness are matched. The rule for matching includes: when the subpixel is switched from low grayscale to high grayscale, the maximal brightness of the curve of the R/G/B luminance and the time response of the driving target being not more than 110% of the target brightness; otherwise, the minimal brightness of the curve of the R/G/B luminance and the time response is not less than 90% of the target brightness. By using the matching rule, swift switching of H/L switching between upper-intermediate grayscale and low grayscale is realized, and wide viewing angle and transmittance remain.

1 Claim, 1 Drawing Sheet

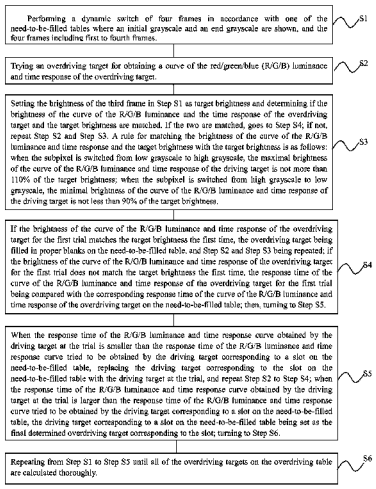

(52) U.S. Cl.
CPC . *G09G 2300/0452* (2013.01); *G09G 2310/08* (2013.01); *G09G 2320/028* (2013.01); *G09G 2320/0285* (2013.01); *G09G 2320/064* (2013.01); *G09G 2360/16* (2013.01)

(56) References Cited

U.S. PATENT DOCUMENTS

| | | | | |
|---|---|---|---|---|
| 2004/0131273 | A1* | 7/2004 | Johnson | G06T 5/008 382/254 |
| 2005/0125179 | A1* | 6/2005 | Selby | G09G 3/006 702/85 |
| 2005/0184948 | A1* | 8/2005 | Halfant | G09G 3/3648 345/98 |
| 2006/0164687 | A1* | 7/2006 | Huang | G09G 3/3611 358/3.01 |
| 2006/0180807 | A1* | 8/2006 | Bechtel | H01L 51/52 257/40 |
| 2009/0303705 | A1* | 12/2009 | Waumans | F21S 8/04 362/228 |
| 2012/0092387 | A1 | 4/2012 | Yang | |
| 2015/0281631 | A1* | 10/2015 | Nakamura | G03B 21/208 348/744 |

FOREIGN PATENT DOCUMENTS

| | | | |
|---|---|---|---|
| CN | 204926053 | U | 12/2015 |
| CN | 105511669 | A | 4/2016 |
| CN | 105511670 | A | 4/2016 |
| JP | 2006023386 | A | 1/2006 |

* cited by examiner

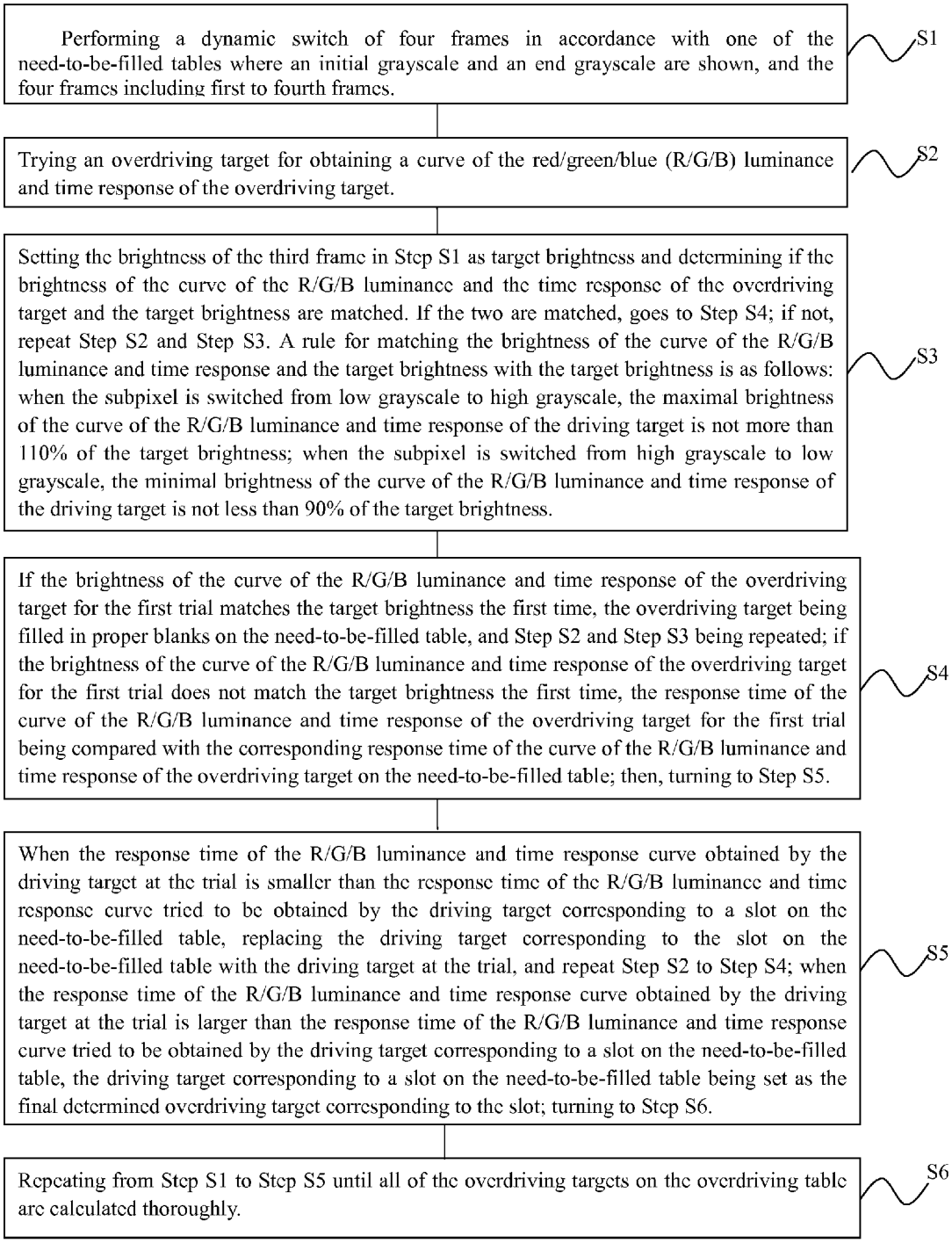
Performing a dynamic switch of four frames in accordance with one of the need-to-be-filled tables where an initial grayscale and an end grayscale are shown, and the four frames including first to fourth frames.
S1
Trying an overdriving target for obtaining a curve of the red/green/blue (R/G/B) luminance and time response of the overdriving target.
S2
Setting the brightness of the third frame in Step S1 as target brightness and determining if the brightness of the curve of the R/G/B luminance and the time response of the overdriving target and the target brightness are matched. If the two are matched, goes to Step S4; if not, repeat Step S2 and Step S3. A rule for matching the brightness of the curve of the R/G/B luminance and time response and the target brightness with the target brightness is as follows: when the subpixel is switched from low grayscale to high grayscale, the maximal brightness of the curve of the R/G/B luminance and time response of the driving target is not more than 110% of the target brightness; when the subpixel is switched from high grayscale to low grayscale, the minimal brightness of the curve of the R/G/B luminance and time response of the driving target is not less than 90% of the target brightness.
S3
If the brightness of the curve of the R/G/B luminance and time response of the overdriving target for the first trial matches the target brightness the first time, the overdriving target being filled in proper blanks on the need-to-be-filled table, and Step S2 and Step S3 being repeated; if the brightness of the curve of the R/G/B luminance and time response of the overdriving target for the first trial does not match the target brightness the first time, the response time of the curve of the R/G/B luminance and time response of the overdriving target for the first trial being compared with the corresponding response time of the curve of the R/G/B luminance and time response of the overdriving target on the need-to-be-filled table; then, turning to Step S5.
S4
When the response time of the R/G/B luminance and time response curve obtained by the driving target at the trial is smaller than the response time of the R/G/B luminance and time response curve tried to be obtained by the driving target corresponding to a slot on the need-to-be-filled table, replacing the driving target corresponding to the slot on the need-to-be-filled table with the driving target at the trial, and repeat Step S2 to Step S4; when the response time of the R/G/B luminance and time response curve obtained by the driving target at the trial is larger than the response time of the R/G/B luminance and time response curve tried to be obtained by the driving target corresponding to a slot on the need-to-be-filled table, the driving target corresponding to a slot on the need-to-be-filled table being set as the final determined overdriving target corresponding to the slot; turning to Step S6.
S5
Repeating from Step S1 to Step S5 until all of the overdriving targets on the overdriving table are calculated thoroughly.
S6

METHOD OF COMPUTING TARGET VALUES BASED ON BRIGHTNESS SWITCHING ON A SUBPIXEL SIGNAL

BACKGROUND OF THE INVENTION

1. Field of the Invention

The present invention relates to the field of multi-domain vertical alignment liquid crystal displays (MVA-LCD), and more particularly, to a method of computing an overdriving target based on brightness switching on a subpixel signal.

2. Description of the Prior Art

For MVA LCDs, wash out easily occurs to images with a wide view due to unbalance of cell gaps. Many measures are proposed for improving the display effect of images with a wide view such as multi-domain, one gate line and one data line (1G1D) coupling, and two gate lines and one data line (2D1G) techniques.

The 2D1G technique is that: each pixel comprises a main pixel and a subpixel. The area of the main pixel and the area of the subpixel are not equal. The main pixel and the subpixel in the same pixel are connected to different data lines and the same gate line. Since different data signals (with different grayscales) are inserted to the main pixel and the subpixel, diverse display brightness and squinty brightness are produced so as to resolve the problem of color cast when a user watches images sideways and squintingly. The feature of the 2D1G technique is that signals can be given to the main pixel and the subpixel, respectively. It helps improve the display effect of wide viewing angles through different gamma curves. However, the 2D1G technique may bring up a problem of lowering transmittance.

Therefore, to resolve the above-mentioned problem, it is necessary to provide a method of computing an overdriving target based on brightness switching on a subpixel signal.

SUMMARY OF THE INVENTION

To fulfill the deficiency of the conventional technology and to satisfy the display effect of images with a wide view and transmittance, an object of the present invention is to provide a method of computing an overdriving target based on brightness switching on a subpixel signal.

According to the present invention, a method of computing an overdriving target based on brightness switching on a subpixel signal comprises:

Step S1: performing a dynamic switch of four frames in accordance with a need-to-be-filled table where an initial grayscale and an end grayscale are shown, and the four frames comprising first to fourth frames;

Step 2: trying an overdriving target for obtaining a curve of red/green/blue (R/G/B) luminance and time response of the overdriving target;

Step S3: setting brightness of the third frame in Step S1 as target brightness, determining if brightness of the curve of the R/G/B luminance and the time response of the overdriving target and the target brightness are matched, if the two are matched, going to the step S4, if not, repeating the step 2 and the step S3, and a rule for matching comprising:

when the subpixel is switched from low grayscale to high grayscale, the maximal brightness of the curve of the R/G/B luminance and the time response of the driving target being not more than 110% of the target brightness;

when the subpixel is switched from high grayscale to low grayscale, the minimal brightness of the curve of the R/G/B luminance and the time response of the driving target is not less than 90% of the target brightness;

the low grayscale being lower than the grayscale of a first default threshold, the high grayscale being higher than the grayscale of a second default threshold, and the first default threshold being smaller than the second default threshold;

Step S4: filling the overdriving target in proper blanks on the need-to-be-filled table, and repeating the step 2 and the step S3 if the brightness of the curve of the R/G/B luminance and the time response of the overdriving target for a first trial matches the target brightness the first time, comparing the response time of the curve of the R/G/B luminance and the time response of the overdriving target for the first trial with a corresponding response time of the curve of the R/G/B luminance and the time response of the overdriving target on the need-to-be-filled table if the brightness of the curve of the R/G/B luminance and the time response of the overdriving target for the first trial does not match the target brightness the first time, and turning to step S5;

Step S5: replacing the driving target corresponding to a slot on the need-to-be-filled table with the driving target at the trial and repeating the step 2 to the step S4 when the response time of the R/G/B luminance and the time response curve obtained by the driving target at the trial is smaller than the response time of the R/G/B luminance and the time response curve tried to be obtained by the driving target corresponding to the slot on the need-to-be-filled table, setting the driving target corresponding to the slot on the need-to-be-filled table as the final determined overdriving target corresponding to the slot when the response time of the R/G/B luminance and the time response curve obtained by the driving target at the trial is larger than the response time of the R/G/B luminance and the time response curve tried to be obtained by the driving target corresponding to the slot on the need-to-be-filled table, and turning to step S6;

Step S6: repeating from the step 51 to the step S5 until all of the overdriving targets on the overdriving table are calculated thoroughly.

Furthermore, the first default threshold is grayscale of 50, and the second default threshold is grayscale of 200, the low grayscale is lower than the grayscale of 50, and the high grayscale is higher than the grayscale of 200.

Furthermore, the step 2 is further followed by steps of: processing the curve of the R/G/B luminance and the time response with noise smoothing obtained through the step 2.

Furthermore, a median filter is used for processing the curve of the R/G/B luminance and the time response with noise smoothing in the step 2.

Furthermore, the need-to-drive overdriving table is an overdriving table of 17×17, 33×33, or 65×65, and at least one of the initial grayscale is different the end grayscale on the need-to-drive overdriving table for repeating the step 51.

Furthermore, an overdriving target tried to repeat the step 2 every time is different.

Furthermore, the overdriving target is tried in an order from smaller to larger numbers in the step 2.

Furthermore, the overdriving target is tried in an order from larger to smaller numbers in the step 2.

Furthermore, compared with raw data of the curve of the R/G/B luminance and the time response in the step S4 for determining the overdriving target.

Furthermore, the brightness of the third frame is 3000 lumen (LM).

Through a more powerful brightness matching rule, the present invention makes it possible that swift switching of High/Low (H/L) switching between upper-intermediate grayscale (>200) and low grayscale (<50). Also, the feature of wide viewing angle is kept, and transmittance does not lower.

BRIEF DESCRIPTION OF THE DRAWINGS

FIG. 1 illustrates a flowchart of a method of computing an overdriving target based on brightness switching on a subpixel signal according to a preferred embodiment of the present invention.

DETAILED DESCRIPTION OF THE PREFERRED EMBODIMENTS

For better understanding embodiments of the present invention, the following detailed description taken in conjunction with the accompanying drawings is provided. Apparently, the accompanying drawings are merely for some of the embodiments of the present invention. Any ordinarily skilled person in the technical field of the present invention could still obtain other accompanying drawings without use laborious invention based on the present accompanying drawings.

The longest common subsequence (LCS) design of BH/BL is proposed by the conventional technology. The LCS design ensures that the effect of wide viewing angles is improved with a certain level of transmittance. Also, a time domain is created in the LCS design for preventing reduction of image resolution. However, the created time domain may lead to flickers of images. The signal of the subpixel finishes a change of the H-L in one frame and starts repetitions of the H-L in the next frame. Since the H-L varies a lot sometimes, big differences of brightness may be sensed obviously. Especially, when a green sub-pixel (green subpixel G) is added to changes, obvious flickers on the whole image are shown. To increase H/L switching frequencies is the solution to the problem. The display frequency as 60 Hz of the display device increases much more such as 120 Hz.

When the H/L switches in the time domain, especially switching to higher frequencies, liquid crystal molecules in the switching period may not be able to convert to compatible positions because of the characteristics of the liquid crystal molecules responding to time, like active shutter three dimensional (3D) technology. To drive the liquid crystal molecules with over drive is necessary at this time so that the liquid crystal molecules can convert to target positions swiftly. In this way, the brightness for display will not change obviously, which prevents bad display effects.

An object of the present invention is to provide a method of computing an overdriving target based on H/L switching of the subpixel signal in the longest common subsequence (LCS) technology where four-domain time switching is adopted.

Swift switching of H/L switching between upper-intermediate grayscale (>200) and low grayscale (<50) often occurs. Different from ordinary conversion of grayscales of images, the span of the H/L switching is larger. So it is necessary to set a powerful overdriving target when the overdriving table is used for calculation. The conventional method for calculation of overdriving targets is used in the present invention.

Please refer to FIG. 1. A method of computing an overdriving target based on brightness switching on a subpixel signal proposed by the present invention comprises:

Step S1: Performing a dynamic switch of four frames in accordance with one of the need-to-be-filled tables where an initial grayscale and an end grayscale are shown, and the four frames including first to fourth frames.

Step S2: Trying an overdriving target for obtaining a curve of the red/green/blue (R/G/B) luminance and time response of the overdriving target.

Step S3: Setting the brightness of the third frame in Step S1 as target brightness and determining if the brightness of the curve of the R/G/B luminance and the time response of the overdriving target and the target brightness are matched. If the two are matched, goes to Step S4; if not, repeat Step S2 and Step S3. A rule for matching the brightness of the curve of the R/G/B luminance and time response and the target brightness with the target brightness is as follows:

when the subpixel is switched from low grayscale to high grayscale, the maximal brightness of the curve of the R/G/B luminance and time response of the driving target is not more than 110% of the target brightness;

when the subpixel is switched from high grayscale to low grayscale, the minimal brightness of the curve of the R/G/B luminance and time response of the driving target is not less than 90% of the target brightness;

the low grayscale is lower than the grayscale of a first default threshold, and the high grayscale is higher than the grayscale of a second default threshold. The first default threshold is smaller than the second default threshold.

Step S4: If the brightness of the curve of the R/G/B luminance and time response of the overdriving target for the first trial matches the target brightness the first time, the overdriving target being filled in proper blanks on the need-to-be-filled table, and Step S2 and Step S3 being repeated; if the brightness of the curve of the R/G/B luminance and time response of the overdriving target for the first trial does not match the target brightness the first time, the response time of the curve of the R/G/B luminance and time response of the overdriving target for the first trial being compared with the corresponding response time of the curve of the R/G/B luminance and time response of the overdriving target on the need-to-be-filled table; then, turning to Step S5.

Step S5: When the response time of the R/G/B luminance and time response curve obtained by the driving target at the trial is smaller than the response time of the R/G/B luminance and time response curve tried to be obtained by the driving target corresponding to a slot on the need-to-be-filled table, replacing the driving target corresponding to the slot on the need-to-be-filled table with the driving target at the trial, and repeat Step S2 to Step S4; when the response time of the R/G/B luminance and time response curve obtained by the driving target at the trial is larger than the response time of the R/G/B luminance and time response curve tried to be obtained by the driving target corresponding to a slot on the need-to-be-filled table, the driving target corresponding to a slot on the need-to-be-filled table being set as the final determined overdriving target corresponding to the slot; turning to Step S6.

Step S6: Repeating from Step S1 to Step S5 until all of the overdriving targets on the overdriving table are calculated thoroughly.

According a preferred embodiment of the present invention, the method of computing target values based on brightness switching on a subpixel signal comprises the steps of:

Step 1: Performing a dynamic switch of four frames in accordance with one of the need-to-be-filled tables where an initial grayscale and an end grayscale are shown, and the four frames including first to fourth frames.

In this embodiment, the response curve between grayscale and grayscale in the display device is measured. Since a display device comprises 256 grayscales generally, it is unrealistic to measure all curves of brightness between the grayscale and grayscale. Take the storage space and function of the chip into considerations, an overdriving table of 17×17, 33×33, or 65×65 is used in general. However, it is not limited to overdriving table of 17×17, 33×33, and 65×65. A real trial may be a measure of the response curve between grayscale and grayscale of 65×65. The middle is interpolation. The measure of 65×65 is adopted in this embodiment.

When the step is repeated, the table chosen each time is different from another. That is, at least one of the initial grayscale is different the end grayscale on the need-to-drive overdriving table for repetitions.

The first frame is a driving signal for realizing an initial grayscale. The second frame is a driving signal for realizing a grayscale between the initial grayscale and the end grayscale. The third and fourth frames are driving signals for realizing an end grayscale.

Step 2: Trying an overdriving target for obtaining a curve of the red/green/blue (R/G/B) luminance and time response of the overdriving target.

When Step 2 is repeated, the overdriving target tried to repeat each time is different from another. The overdriving target is tried in an order from smaller to larger numbers or from larger to smaller numbers in a repetitive order. Specifically, is depends on a practical demand to choose.

Step 3: Processing the curve of the R/G/B luminance and time response with noise smoothing in Step 2.

A median filter is used for processing the curve of the R/G/B luminance and time response with noise smoothing in Step 2 for improving the speed of subsequent calculation and accuracy of calculation.

Step 4: Setting the brightness of the third frame in Step 1 as target brightness and determining if the brightness of the curve of the R/G/B luminance and the time response of the overdriving target and the target brightness are matched. If the two are matched, goes to Step S5; if not, repeat Step 2 and Step 4.

The brightness of the third frame is about 3000 lumen (LM) in Step 4. A rule for matching the brightness of the curve of the R/G/B luminance and time response and the target brightness with the target brightness is as follows:

when the subpixel is switched from low grayscale to high grayscale, the maximal brightness of the curve of the R/G/B luminance and time response of the driving target is not more than 110% of the target brightness;

when the subpixel is switched from high grayscale to low grayscale, the minimal brightness of the curve of the R/G/B luminance and time response of the driving target is not less than 90% of the target brightness;

the low grayscale is lower than the grayscale of a first default threshold, and the high grayscale is higher than the grayscale of a second default threshold. The first default threshold is smaller than the second default threshold. The first default threshold is grayscale of 50, and the second default threshold is grayscale of 200 in this embodiment. The low grayscale is lower than the grayscale of 50, and the high grayscale is higher than the grayscale of 200. The effect of over drive from high grayscale to lower grayscale is better after the demand is satisfied.

Step S5: If the brightness of the curve of the R/G/B luminance and time response of the overdriving target for the first trial matches the target brightness the first time, the overdriving target being filled in proper blanks on the need-to-be-filled table, and Step 2 and Step 4 being repeated; if the brightness of the curve of the R/G/B luminance and time response of the overdriving target for the first trial does not match the target brightness the first time, the response time of the curve of the R/G/B luminance and time response of the overdriving target for the first trial being compared with the corresponding response time of the curve of the R/G/B luminance and time response of the overdriving target on the need-to-be-filled table; then, turning to Step 6.

Step 6: When the response time of the R/G/B luminance and time response curve obtained by the driving target at the trial is smaller than the response time of the R/G/B luminance and time response curve tried to be obtained by the driving target corresponding to a slot on the need-to-be-filled table, replacing the driving target corresponding to the slot on the need-to-be-filled table with the driving target at the trial, and repeat Step 2 to Step S5; when the response time of the R/G/B luminance and time response curve obtained by the driving target at the trial is larger than the response time of the R/G/B luminance and time response curve tried to be obtained by the driving target corresponding to a slot on the need-to-be-filled table, the driving target corresponding to a slot on the need-to-be-filled table being set as the final determined overdriving target corresponding to the slot; turning to Step 7.

Compared with the initial grayscale set as 32, the target grayscale comprises of the raw data of the curve of the R/G/B luminance and time response with 0-255 grayscales to determine the overdriving target.

Step 7: Repeating from Step 1 to Step 6 until all of the overdriving targets on the overdriving table are calculated thoroughly.

Conventional over drive works only for dynamic images while over drive in the present invention works for both static and dynamic images because temporal LCS design where H/L switches is adopted. Grayscales of subpixels continue switching.

Based on what is described above, it shows that a powerful matching rule of brightness is proposed by the present invention. It is possible that swift switching of H/L switching between upper-intermediate grayscale (>200) and low grayscale (<50). Also, the feature of wide viewing angle is kept, and transmittance does not lower.

The terms "a" or "an", as used herein, are defined as one or more than one. The term "another", as used herein, is defined as at least a second or more. The terms "including" and/or "having" as used herein, are defined as comprising. It should be noted that if it is described in the specification that one component is "connected," "coupled" or "joined" to another component, a third component may be "connected," "coupled," and "joined" between the first and second components, although the first component may be directly connected, coupled or joined to the second component.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A method of computing an overdriving target based on brightness switching on a subpixel signal of a liquid crystal display device comprising the steps of:

(a) performing a dynamic switch of four frames in accordance with a need-to-be-filled table, where an initial grayscale and an end grayscale are shown, and the four frames comprising first frame, second frame, third frame and fourth frame;

(b) trying the overdriving target for obtaining a curve of red, green, and blue (RGB) luminance and time response of the overdriving target;

(c) setting brightness of the third frame in step (a) as target brightness, determining if brightness of the curve of the RGB luminance and the time response of the overdriving target and the target brightness are matched, if the two are matched, going to the step (d), if not, repeating the step (b) and the step (c), and a rule for matching comprising:

when the subpixel signal is switched from low grayscale to high grayscale, the maximal brightness of the curve of the RGB luminance and the time response of the driving target being not more than 110% of the target brightness;

when the subpixel signal is switched from high grayscale to low grayscale, the minimal brightness of the curve of the RGB luminance and the time response of the driving target is not less than 90% of the target brightness; and the low grayscale being lower than the grayscale of a first default threshold, the high grayscale being higher than the grayscale of a second default threshold, and the first default threshold being smaller than the second default threshold;

(d) filling the overdriving target in proper blanks on the need-to-be-filled table, and repeating the step (b) and the step (c) if the brightness of the curve of the RGB luminance and the time response of the overdriving target for a first trial matches the target brightness the first time, comparing the response time of the curve of the RGB luminance and the time response of the overdriving target for the first trial with a corresponding response time of the curve of the RGB luminance and the time response of the overdriving target on the need-to-be-filled table if the brightness of the curve of the RGB luminance and the time response of the overdriving target for the first trial does not match the target brightness the first time, and turning to step (e);

(e) replacing the driving target corresponding to a slot on the need-to-be-filled table with the driving target at the first trial and repeating the step (b) to the step (d) when the response time of the RGB luminance and the time response curve obtained by the driving target at the first trial is smaller than the response time of the RGB luminance and the time response curve tried to be obtained by the driving target corresponding to the slot on the need-to-be-filled table, setting the driving target corresponding to the slot on the need-to-be-filled table as the final determined overdriving target corresponding to the slot when the response time of the RGB luminance and the time response curve obtained by the driving target at the first trial is larger than the response time of the RGB luminance and the time response curve tried to be obtained by the driving target corresponding to the slot on the need-to-be-filled table, and turning to step (f);

(f) repeating from the step (a) to the step (e) until all of the overdriving targets on the need-to-be-filled table are calculated thoroughly, wherein the need-to-be-filled table is an overdriving table of 65×65, and the initial grayscale is different from the end grayscale.

* * * * *